US010724751B2

(12) United States Patent
Kraal et al.

(10) Patent No.: US 10,724,751 B2
(45) Date of Patent: Jul. 28, 2020

(54) VENT

(71) Applicant: IVR GROUP PTY LTD, Picton, NSW (AU)

(72) Inventors: Andrea Trudy Kraal, Picton (AU); Stephen Bird, Picton (AU)

(73) Assignee: IVR GROUP PTY LTD, Picton, NSW (AU)

( * ) Notice: Subject to any disclaimer, the term of this patent is extended or adjusted under 35 U.S.C. 154(b) by 0 days.

(21) Appl. No.: 15/560,022

(22) PCT Filed: Mar. 23, 2016

(86) PCT No.: PCT/AU2016/050208

§ 371 (c)(1),
(2) Date: Sep. 20, 2017

(87) PCT Pub. No.: WO2016/149755

PCT Pub. Date: Sep. 29, 2016

(65) Prior Publication Data

US 2018/0066857 A1 Mar. 8, 2018

(30) Foreign Application Priority Data

Mar. 23, 2015 (AU) ..... 2015201503

(51) Int. Cl.
*F24F 7/02* (2006.01)
*F23L 17/02* (2006.01)
(Continued)

(52) U.S. Cl.
CPC ..... *F24F 7/02* (2013.01); *F23L 13/06* (2013.01); *F23L 17/02* (2013.01); *F23L 17/10* (2013.01);
(Continued)

(58) Field of Classification Search
CPC ..... F24F 7/02; F24F 13/12; F24F 2221/52; F23L 13/06; F23L 17/02; F23L 17/10
(Continued)

(56) References Cited

U.S. PATENT DOCUMENTS 2,715,867 A * 8/1955 Kennedy ..... F24F 13/062 454/312
3,063,356 A * 11/1962 Fitt ..... F24F 13/062 454/312
(Continued)

FOREIGN PATENT DOCUMENTS

GB 968355 A 9/1964
GB 1112173 A 5/1968
(Continued)

OTHER PUBLICATIONS

International Search Report and Written Opinion of the International Search Authority corresponding to PCT/AU2016/050208, dated Jun. 16, 2016, 14 pages.
(Continued)

*Primary Examiner* — Steven B McAllister
*Assistant Examiner* — Allen R Schult
(74) *Attorney, Agent, or Firm* — Kilpatrick Townsend & Stockton LLP

(57) ABSTRACT

A vent that includes: a rotary head with blades arranged between a top and bottom section of the rotary head; a fixed component to mount the rotary head to a roof of a building, the fixed component having a throat that provides a flow path from inside the building to an interior of the rotary head; and a diffuser to split airflow vented from the throat and direct the vented airflow out through the rotary head.

19 Claims, 8 Drawing Sheets

(51) Int. Cl.

| | |
|---|---|
| ***F23L 13/06*** | (2006.01) |
| ***F23L 17/10*** | (2006.01) |
| ***F24F 13/062*** | (2006.01) |
| ***F24F 13/12*** | (2006.01) |

(52) U.S. Cl.
CPC ..... *F24F 13/062* (2013.01); *F24F 13/12* (2013.01); *F24F 2221/52* (2013.01)

(58) Field of Classification Search
USPC ..... 454/18
See application file for complete search history.

(56) References Cited

U.S. PATENT DOCUMENTS

| | | | | |
|---|---|---|---|---|
| 5,326,313 | A * | 7/1994 | Miniat | F23L 17/10 454/18 |
| 5,571,045 | A | 11/1996 | Tsung | |
| 6,302,778 | B1 | 10/2001 | Andrews et al. | |
| 2004/0097184 | A1* | 5/2004 | Munn | F23L 17/005 454/18 |
| 2008/0153410 | A1* | 6/2008 | Naber | F24F 7/02 454/347 |

FOREIGN PATENT DOCUMENTS

| | | | |
|---|---|---|---|
| GB | 1345456 | A | 1/1974 |
| WO | WO2011/013105 | A2 | 2/2011 |
| WO | WO2014/036611 | A1 | 3/2014 |

OTHER PUBLICATIONS

Notification of Transmittal of International Preliminary Report on Patentability corresponding to PCT/AU2016/050208, dated Mar. 3, 2017, 6 apges.

International Search Report and Written Opinion of the International Search Authority corresponding to PCT/AU2016/050208, dated Jun. 16, 2016, 15 pages.

Notification of Transmittal of International Preliminary Report on Patentability corresponding to PCT/AU2016/050208, dated Mar. 3, 2017, 17 pages.

* cited by examiner

VENT

RELATED APPLICATION

This application claims the benefit of priority from Australian Patent Application Number 2015201503, the contents of which are incorporated in entirety by reference.

FIELD OF THE INVENTION

The present invention relates to a vent particularly, but not exclusively, a rotary vent for a roof.

BACKGROUND OF THE INVENTION

One known form of rotary roof vent comprises a cylindrical-shaped rotary component and a roof base component that anchors the vent above an opening on the roof of a building. The rotary component includes a series of vertically oriented blades between circular top and bottom bases. The rotary component has a relatively flat profile so that the vent projects only a minimal distance above the roof. Wind force on the blades causes the rotary component to rotate, in order to enhance airflow through the vent to thereby assist ventilation of the building and improve rain protection.

The rotary component is generally orientated in a horizontal configuration and an adjustable or custom made roof base is needed for a sloping or pitched roof to maintain the horizontal aspect of the rotary component.

OBJECT OF THE INVENTION

The present invention seeks to provide an alternative form of vent.

SUMMARY OF THE INVENTION

In accordance with one aspect of the invention, there is provided a vent that includes: a rotary head with blades arranged between a top and bottom section of the rotary head; a roof base component to mount the rotary head to a roof of a building, the roof base component having a throat that provides a flow path from inside the building to an interior of the rotary head; and a diffuser, wherein the diffuser separates air flow vented through the throat into separate airstreams so that the airflow is vertically distributed over the height of the blades when exiting the rotary head.

In one embodiment, the diffuser includes an opening that allows a portion of the airflow to pass through the diffuser so as to vertically split the airflow above and below the diffuser.

In one embodiment, the top section has a reduced diameter relative to the bottom section and the blades are overlapping and canted inwardly from the bottom section to terminate beneath the top section and present a straight line profile between the top and bottom sections.

In one embodiment, the vent further includes a damper adapted to selectively restrict airflow through the throat.

In one embodiment, the damper is adapted to move axially of the throat to at least partially restrict the airflow.

In one embodiment, both the damper and diffuser are adapted to move axially relative to the throat.

In one embodiment, the damper and diffuser are adapted to move axially relative to the throat, from an open condition toward a collapsed condition where the damper is nested in the diffuser and the diffuser is proximate the throat.

In one embodiment, the throat has a curved entry and a curved exit.

In one embodiment, the damper is flared outwardly in a direction away from the throat and the damper has an inverse cone shape to nest inside the diffuser to close the airflow through the diffuser.

In one embodiment, the support includes an axial shaft and the throat, diffuser and damper are arranged co-axially along the shaft.

In one embodiment, each blade has a body with a leading edge that extends between a peak that is connected to the top section and a base that is coupled to the bottom section, whereby the leading edge and body of one blade at least partially overlaps with another blade.

In one embodiment, the profile of the blades is such that a constant distance gap is provided between overlapped regions of adjacent blades.

In one embodiment, the overlapped blades provide a barrier to water entering the vent as a result of rain falling onto the head from above the vent and wind brought rain.

In one embodiment, the body forms an aerofoil and the base of each blade is curved inwardly and away from an outer edge of the bottom section.

In one embodiment, the blades have attachment points along the peak and the base for receiving fasteners to secure the blades to the top and bottom sections.

In another embodiment, the rotary head is mounted on the support so that the bottom section forms a skirt around the throat, which is proximate the roof of the building.

In another aspect, there is provided a vent with a rotary head with blades arranged between a top and bottom section of the rotary head, and a roof base component to mount the rotary head to a roof of a building, the roof base component having a throat that provides a flow path from inside the building to an interior of the rotary head, wherein an outer periphery of the top section forms an angle relative to an exit of the throat in the order of 25 degrees so that the roof base component and rotary head are able to operate on an angle to match a roof pitch in the order of up to 15 degrees from horizontal.

In another aspect, there is provided a vent with a rotary head with blades arranged between a top and bottom section of the rotary head, and a roof base component to mount the rotary head to a roof of a building, the roof base component having a throat that provides a flow path from inside the building to an interior of the rotary head, wherein the roof base component includes a brace that extends across the throat to carry a support on which the rotary head is mounted and the brace, throat and roof base component are integrally formed.

In another aspect, there is provided a vent with a rotary head with blades arranged between a top and bottom section of the rotary head, and a roof base component to mount the rotary head to a roof of a building, the roof base component having a throat that provides a flow path from inside the building to an interior of the rotary head, wherein the profile of the blades is such that a substantially constant distance gap is provided between overlapped regions of adjacent blades.

In another aspect, there is provided a vent with a rotary head with blades arranged between a top and bottom section of the rotary head, and a roof base component to mount the rotary head to a roof of a building, the roof base component having a throat that provides a flow path from inside the building to an interior of the rotary head, wherein the blades are canted inwardly from the bottom section and present a straight line profile between the top and bottom sections.

BRIEF DESCRIPTION OF THE DRAWINGS

The invention is described, by way of non-limiting example only, with reference to the following drawings, in which.

DETAILED DESCRIPTION

Figure 1:
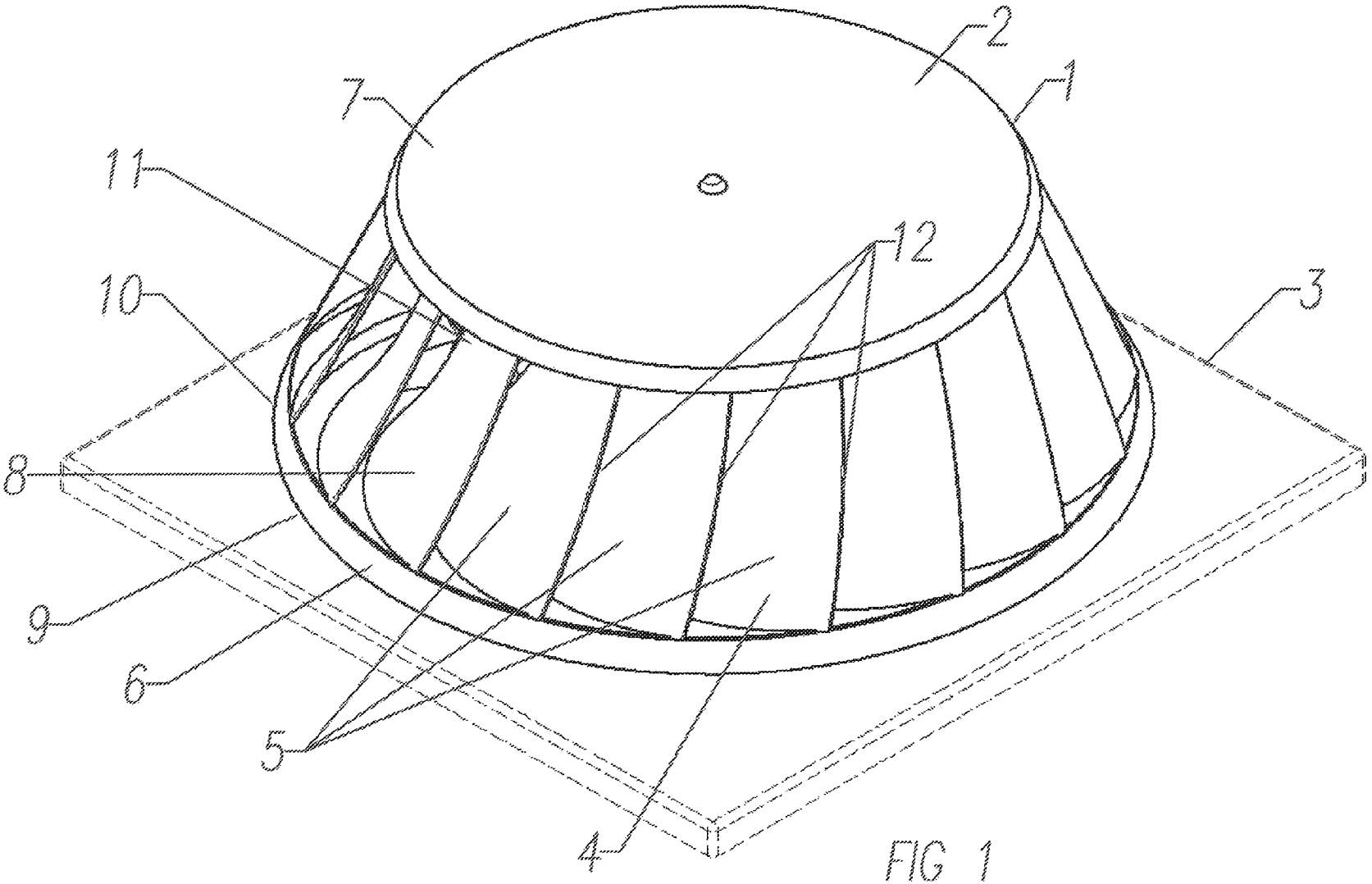
FIG. 1 is a perspective view of a vent.

Throughout the following description, like reference numerals will be used to denote like parts.

Figure 2:
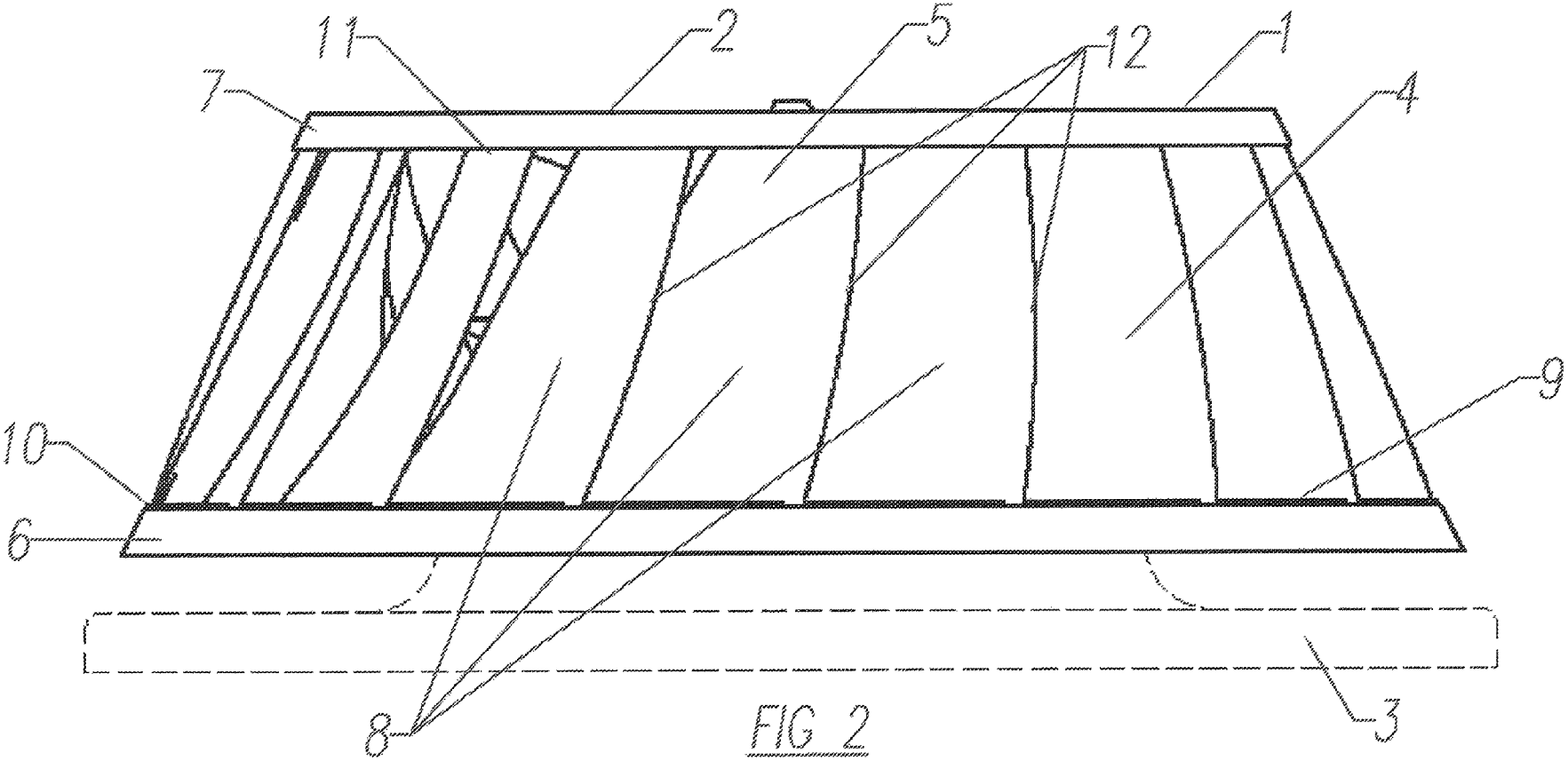
FIG. 2 is a side view of the vent.

Referring firstly to FIGS. 1 and 2, a rotary vent 1 is illustrated with a rotary head 2 and a roof base component 3. The rotary head 2 includes a circular array 4 of blades 5 provided between a circular bottom section 6 and a reduced diameter circular top section 7.

Each blade 5 has a body 8 with a curved base 9 attached to the bottom section 6. The base 9 curves inwardly and away from an outer edge 10 of the bottom section 6. The body 8 of each blade 5 is canted to angle away from vertical and terminate at a peak 11 beneath the top section 7.

The blades 5 are arranged to overlap so that a leading edge 12 of each blade 5 at least partially covers the body 8 of an adjacent blade 5.

Figure 3:
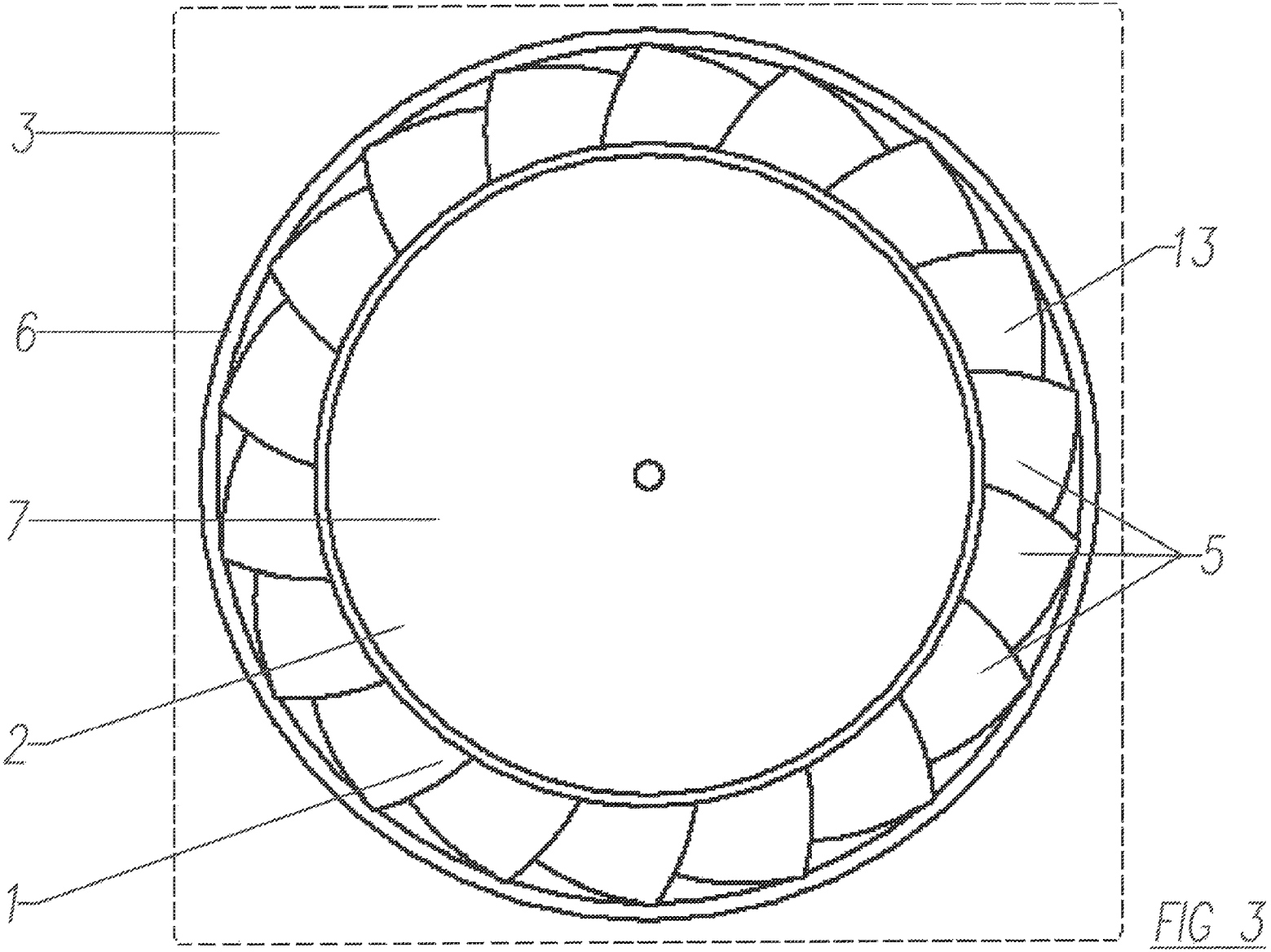
FIG. 3 is a top view of the vent.

Referring to FIG. 3, the overlapped blades 5 are shown to form a substantially continuous barrier 13 between the top and bottom sections 6, 7. The barrier 13 resists water entering the vent 1, in the form of rain falling onto the rotary head 2 from above the vent 1.

Figure 4:
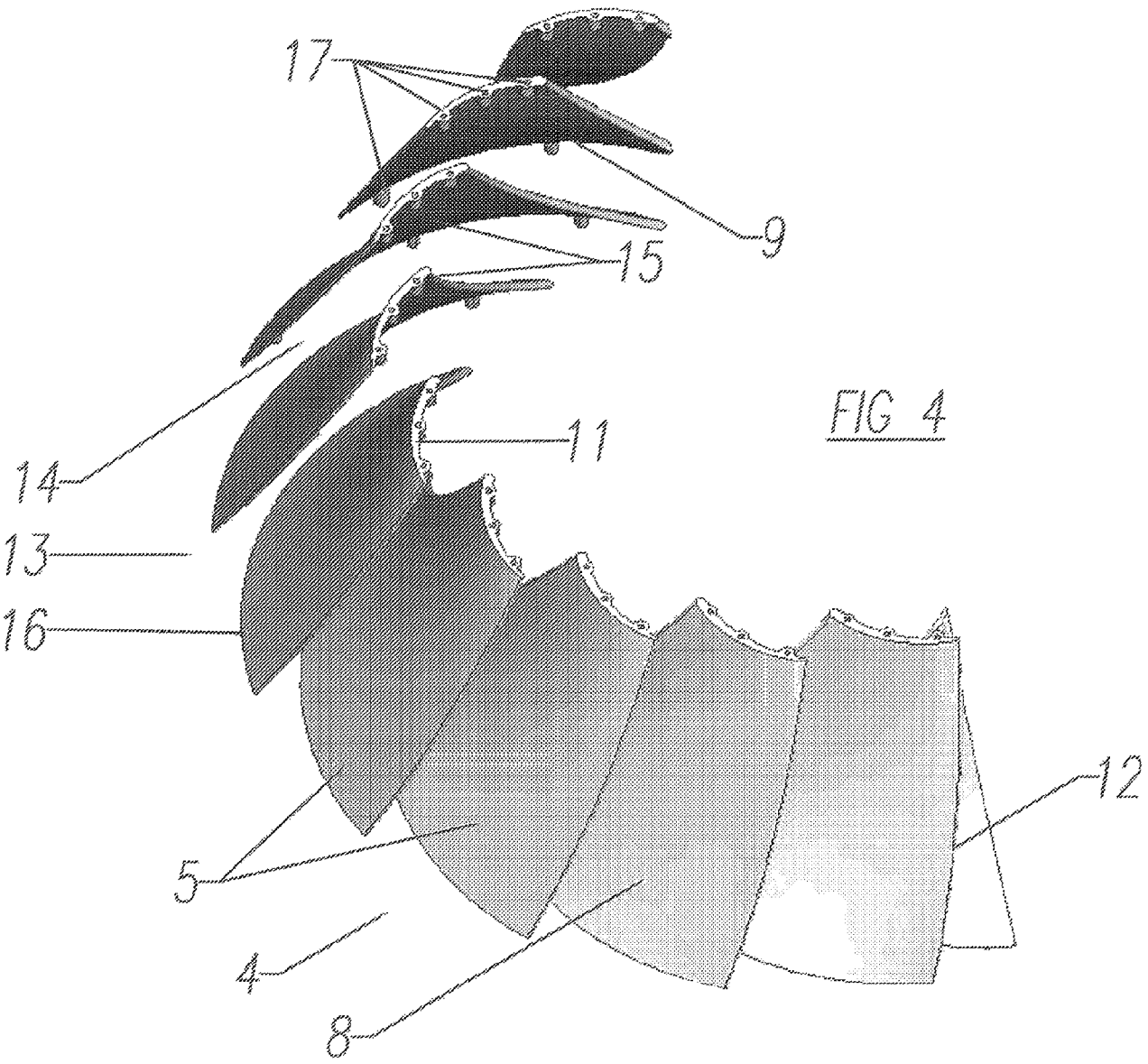
FIG. 4 is a partial perspective view of blades of the vent.

Referring now to FIG. 4, a partial perspective view of the array 4 of blades 5 illustrates the relative positioning of the blades 5. In particular, the blades 5 are aligned so as to maintain a constant distance gap 14 between overlapped regions 15 of adjacent blades 5, which means airflow restriction between the blades 5 is reduced to a minimum.

The leading edge 12 and the body 8 of each blade 5 is also formed with a slight aerofoil shape which reduces pressure on an outside face 16 of the blades 5 and aids in guiding airflow out of the vent 1. Preferably, both the leading edge 12 and trailing edge of each blade are formed with an aerofoil shape so that the vent acts like a centrifuged fan.

The curvature and configuration of the blades 5 is designed to provide an equal exit area across the entire surface and height of each blade 5 whilst also providing a barrier 13 to ingress of rain by virtue of the overlap between adjacent blades 5.

The blades 5 are preferably formed of moulded plastics material for weight, shape, strength and cost effectiveness.

FIG. 4 also shows a set of attachment points 17 at the base 9 and along the peak 11 for connecting the blade 5 to the respective bottom and top sections 6, 7. Although not shown, each blade 5 has a suitable number of attachment points 17 at each of the respective base 9 and peak 11.

Figure 5:
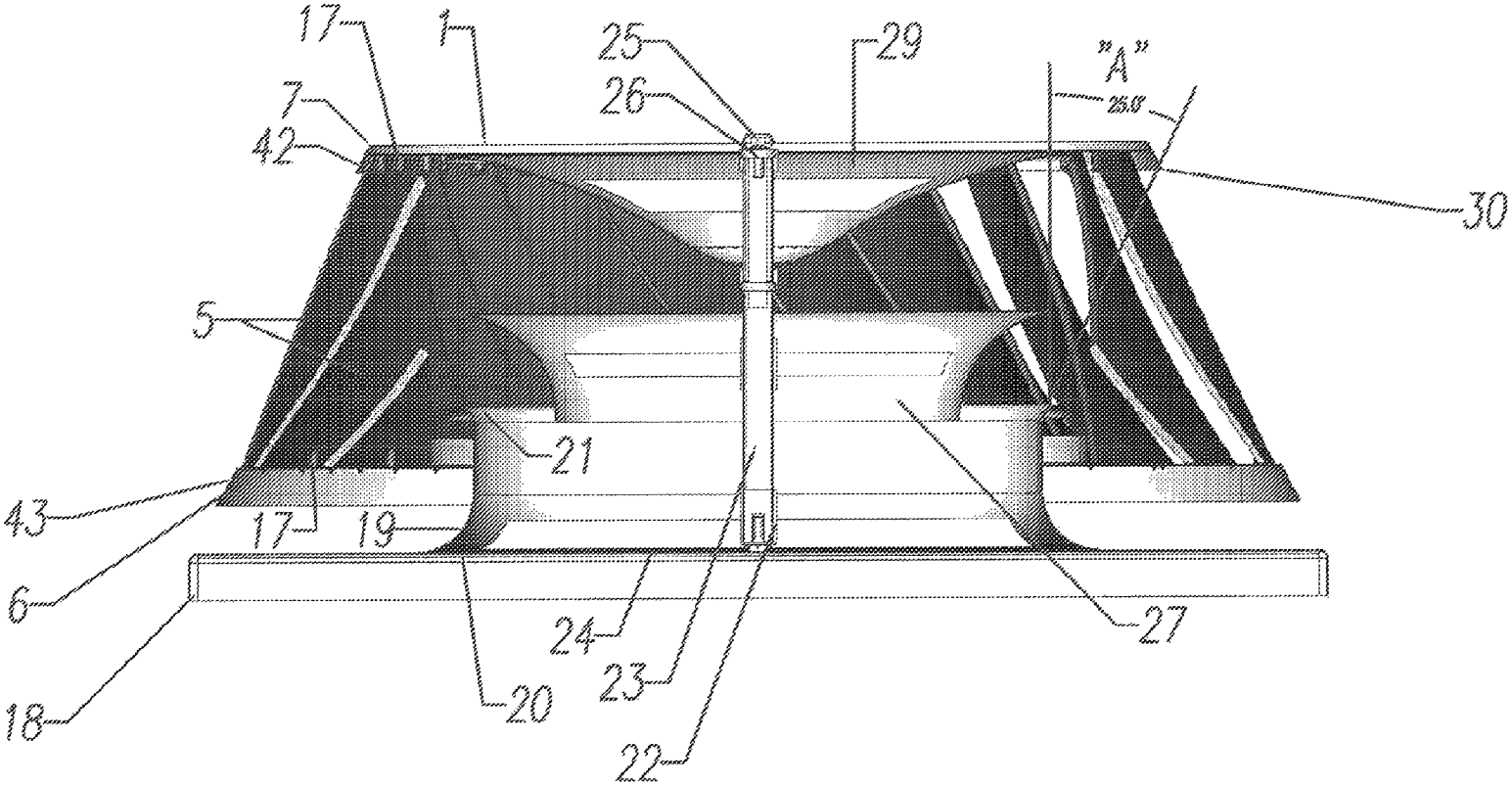
FIG. 5 is a diagrammatic cut-away view of the vent in an open configuration.

Referring now to FIG. 5, a partially sectioned internal view of the vent 1 shows some of the attachment points 17 used to mount the associated blades 5 to the top and bottom sections 6, 7. The blades 5 are mounted directly to a respective flat plate associated with the top and bottom sections 6, 7. The top section 7 then fits over the plate to cover the attachment points 17 and fasteners to give the vent 1 a clean finish. Instead of fasteners and attachment points the blades 5 may alternatively be fixed by suitable flanges and adhesives, as required, or any other suitable fastening mechanisms.

FIG. 5 also shows the roof base component 3 as including a roof base 18 with a central throat 19. The throat 19 has a curved entry 20 and exit 21 to facilitate smooth laminar flow into the throat 19. A support 22, that includes an axial shaft 23, is mounted to a cross brace 24, centrally of the throat 19. A nut 25 is fitted into a remote end 26 of the shaft 23 in order to mount the rotary head 2 to the support 22. The brace 24, throat 19 and roof base component 3 are preferably all integrally formed and mounted directly to a roof so a custom made/adjustable pitch base, as used in the prior art, is not needed.

A diffuser 27 is positioned at the exit 21 of the throat 19 and is mounted co-axially with respect to the shaft 23. The diffuser 27 splits air from the throat 19 and an outwardly flared profile 28 is effective in then guiding the air out through the blades 5.

A damper 29 is located underneath the top section 7. The damper 29 is mounted coaxially with respect to the shaft 23 and is adapted for motorized axial movement along the shaft 23. The damper 29 has an inverted cone shape and is arranged to travel down the shaft 23 from the open configuration shown, toward the throat 19 and into a closed configuration against the diffuser 27.

Figure 8A:
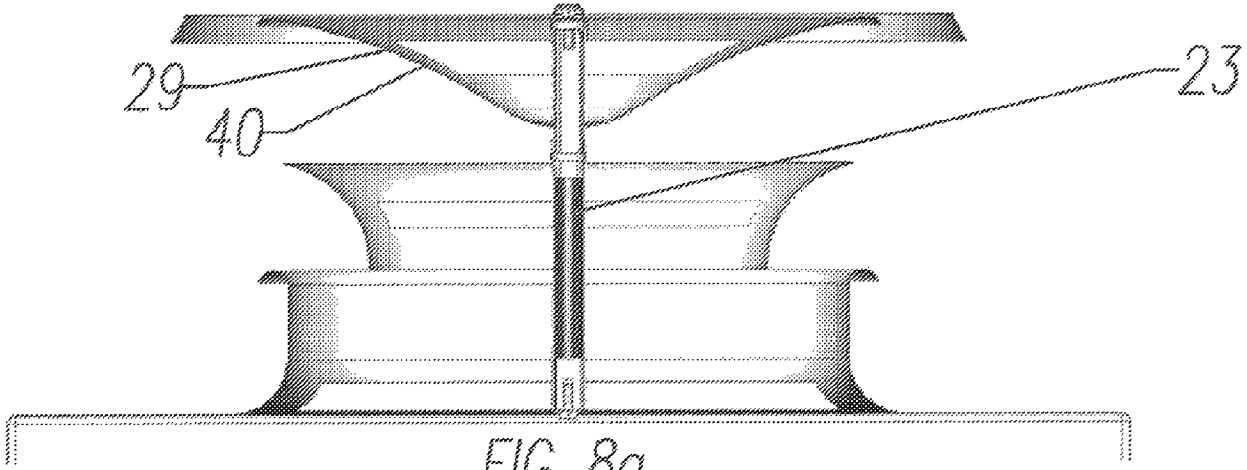
FIG. 8*a* is a diagrammatic side view illustrating an alternative form of damper in an open configuration.
Figure 8B:
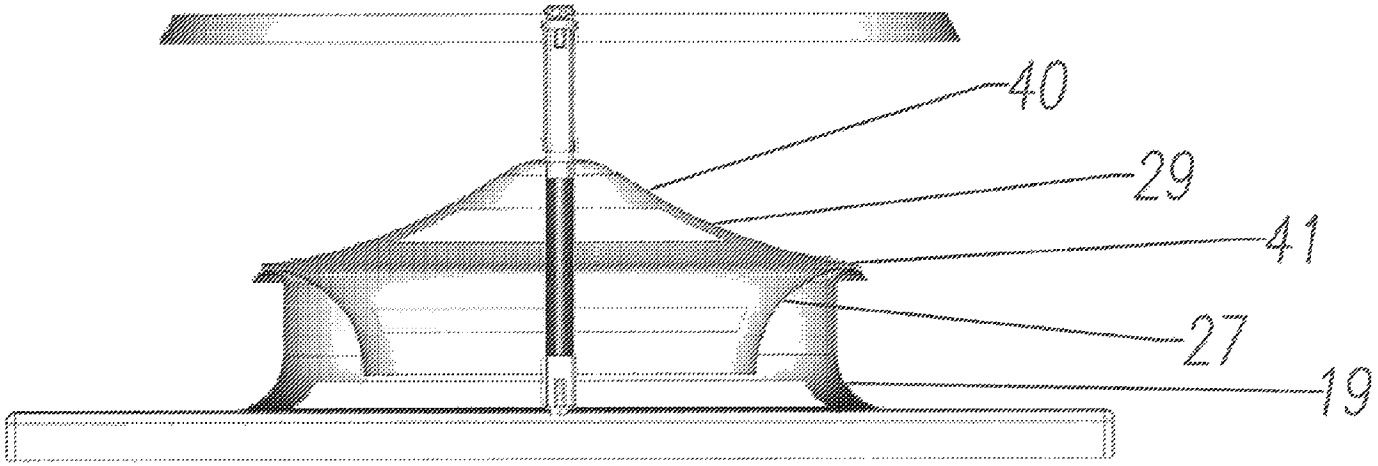
FIG. 8*b* is a diagrammatic side view illustrating the damper in a closed configuration.

In an alternative form, shown in FIG. 8*a*, the damper 29 may include a rubber membrane 40, that has an inverted cone shape in an open configuration. The membrane 40 is fixed onto the shaft 23 whereby to adopt a dome-shape when the damper 29 is moved to a closed configuration as shown in FIG. 8*b*. In that configuration, the membrane 40 seals against the diffuser 27, around edge 41, and closes the throat 19.

Returning now to FIG. 5, in the example shown, an angle 'A' between an outer periphery 30 of the top section 7 and the exit 21 of the throat 19 is preferably designed to be 25 degrees, which will allow the vent 1 to be installed with the base 18 mounted on a roof at, say, up to in the order of 15 degrees while still providing a rain protection angle of 15 degrees.

It is considered that even with the base 18 at a 10 degree angle on a sloping roof, the vent 1 will still have an aesthetically appealing appearance, compared to a prior art vent with a cylindrically shaped rotary component that would appear somewhat unbalanced on a sloping roof.

For aesthetic purposes, the outer periphery 30 is formed of downwardly angled skirting 42 that is designed to match a corresponding skirting 43 that is turned down from the bottom section 6. The matching skirting 42, 43 provides the vent 1 with a distinctive appearance as a result of having a degree of similarity/symmetry between the top and bottom sections 6, 7. Although being curved, the blades also present a straight line between the top and bottom sections 6, 7 when the vent 1 is viewed in profile, which further enhances the clean aesthetic of the vent 1. The vent 1 is preferably restricted to a height of less than about 450 mm to minimise any visual impact the vent 1 may have from ground level.

The turned down skirting 43 also has a function of acting as a dripping edge to minimise splashing.

The bottom section 6 and skirting 43 are also set over and outside the throat 19, so that any rain water coming off the blades 5 and down the skirting 43 is well away from the throat 19.

Figure 6:
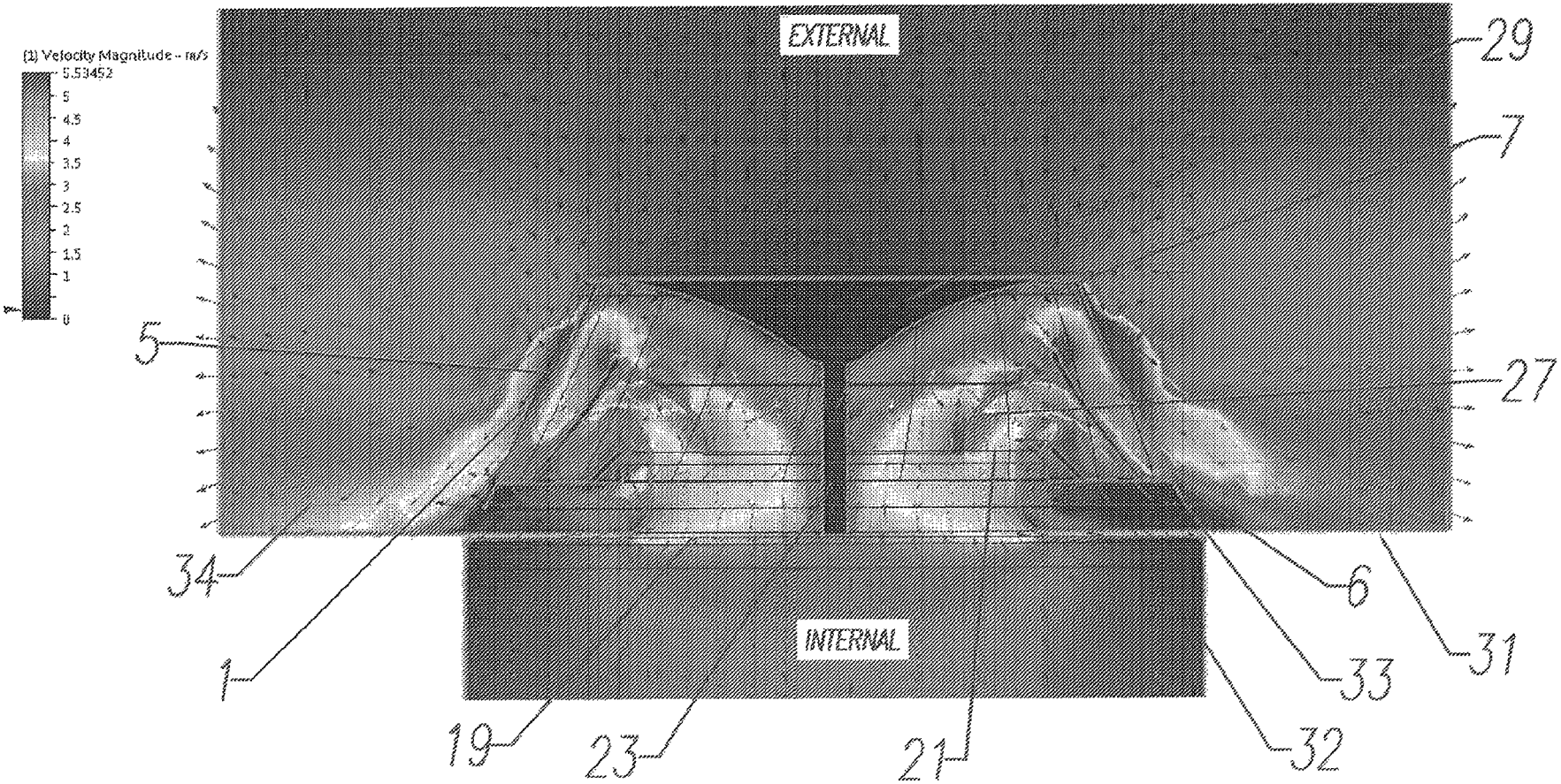
FIG. 6 illustrates airflow through the vent.

Referring now to FIG. 6, the vent 1 is shown mounted to a roof 31 of a building 32, in an environment of little or no wind. The illustrated airflow air inside the building 32 is smoothly transitioned into the throat 19 and out the exit 21. The effectiveness of the diffuser 27 and damper 29 is also shown as the airflow is split by the diffuser 27 and the remaining airstreams are guided along curved profiles of the diffuser 27 and inverted cone of the damper 29 to exit at different positions along the height of the blades 5. As such, the air vented from the throat 19 is guided out of the vent 1 in a distributed manner along the height of the blades.

As can be seen, the rotary head 2 is mounted on the support 22 so that the bottom section 6 forms a skirt 33 around the throat 19, whereby the skirt 33 is proximate the roof 31. This means airflow through the blades 5, adjacent the base 9 of the blades 5, can still be accelerated into any low pressure region 34 that might exist adjacent the roof 31.

In that regard, in high wind environments, the higher velocity winds generally occur at a distance from the roof 31. The shape of a pitched/sloped roof 31 increases the speed of air as it travels across the roof 31. This creates a lower pressure region adjacent the roof 31 and thereby a larger pressure difference with the interior of the building 32, which aids in air escaping the building 32 at a higher rate.

The damper 29 can, of course be used to control the airflow exiting the vent 1, by being driven down the shaft 23 or the vent 1 can be closed completely, if required.

Figure 7:
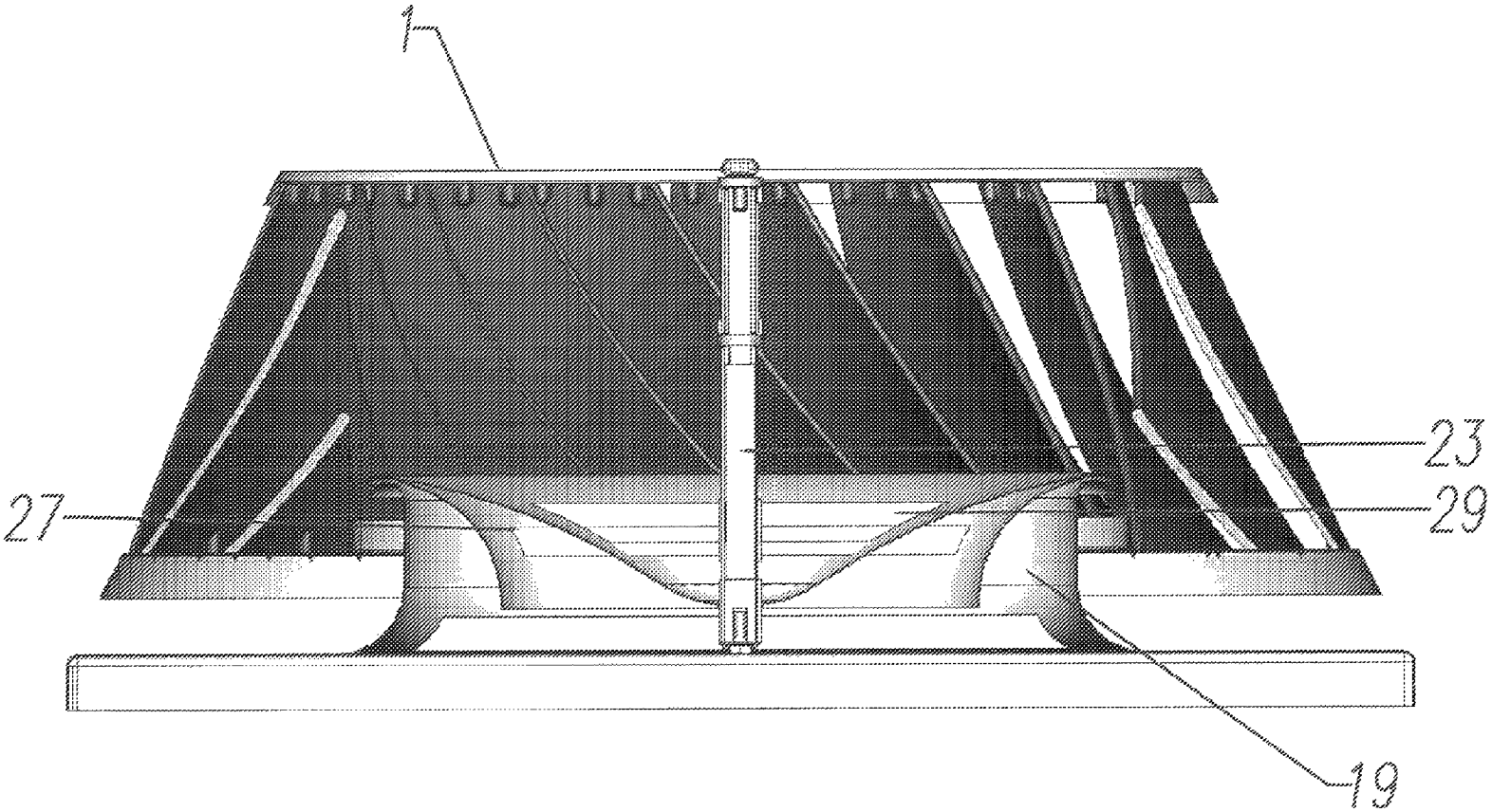
FIG. 7 is a diagrammatic cut-away view showing the vent in a closed configuration.

Referring now to FIG. 7, the vent 1 is shown in a closed configuration, where the damper 29 has been moved down the shaft 23 to nest inside the diffuser 27. The diffuser 27 has also been driven down the shaft 23 to close the throat 19 against air being vented through the rotary vent 1. In the closed configuration, the damper 29 and diffuser 27 can also provide a weather proof seal to prevent water or the like entering the throat 19 of the vent 1.

The vent 1 has been described by way of non-limiting example only and many modifications and variations may be made thereto without departing from the spirit and scope of the invention described.

LIST OF PARTS

1. Rotary vent
2. Rotary head
3. Roof base component
4. Array
5. Blade
6. Bottom section
7. Top section
8. Body
9. Base
10. Outer edge
11. Peak
12. Leading edge
13. Barrier
14. Gap
15. Overlapped regions
16. Outside face
17. Attachment points
18. Roof base
19. Throat
20. Entry
21. Exit
22. Support
23. Shaft
24. Brace
25. Nut
26. Remote end
27. Diffuser
28. Profile
29. Damper
30. Periphery
31. Roof
32. Building
33. Skirt
34. Low pressure region
40. Membrane
41. Edge
42. Skirting
43. Skirting

The invention claimed is:

1. A vent that includes: a rotary head with blades arranged between a top and bottom section of the rotary head wherein each of the blades: (i) are canted inwardly from the bottom section, (ii) present a straight line profile between the top and bottom section, and (iii) taper along a height of the blades from a wider base to a narrower top wherein a profile of the blades is such that a constant distance gap is provided between overlapped regions of adjacent blades; a roof base component to mount the rotary head to a roof of a building, the roof base component having a throat that provides a flow path from inside the building to an interior of the rotary head; and a diffuser, wherein the diffuser includes an opening that allows a portion of airflow from the throat to pass through the diffuser so as to vertically split the airflow above and below the diffuser into separate airstreams whereby the airflow is vertically distributed over the height of the blades when exiting the rotary head, the vent further including a translating damper to selectively restrict the airflow passing through the vent.

2. The vent of claim 1, wherein the diffuser is positioned between the throat and the damper and the opening in the diffuser is axially aligned with the throat.

3. The vent of claim 1, wherein the top section has a reduced diameter relative to the bottom section.

4. The vent of claim 1, wherein the damper has an inverted cone profile facing the diffuser to smoothly guide the airstream passing through the opening and above the diffuser out through the blades of the rotary head.

5. The vent of claim 1, wherein the damper is adapted to move axially of the throat to at least partially restrict the airflow.

6. The vent of claim 5, wherein both the damper and diffuser are adapted to move axially relative to the throat.

7. The vent of claim 5, wherein the damper and diffuser are adapted to move axially relative to the throat, from an open condition toward a collapsed condition where the damper is nested in the diffuser and the diffuser is proximate the throat.

8. The vent of claim 5, wherein the throat has a curved entry and a curved exit.

9. The vent of claim 5, wherein the damper is flared outwardly in a direction away from the throat and the damper has an inverse cone shape to nest inside the diffuser to close the airflow through the diffuser.

10. The vent of claim 5, wherein the roof base component includes a brace that extends across the throat to carry a support on which the rotary head is mounted, the support including an axial shaft and the throat, diffuser and damper are arranged co-axially along the shaft.

11. The vent of claim 1, wherein each blade has a body with a leading edge that extends between a peak that is connected to the top section and a base that is coupled to the bottom section, whereby the leading edge and body of one blade at least partially overlaps with another blade.

12. The vent of claim 11, wherein the overlapped blades provide a barrier to water entering the vent as a result of rain falling onto the head from above the vent.

13. The vent of claim 11, wherein the body forms an aerofoil and the base of each blade is curved inwardly and away from an outer edge of the bottom section.

14. The vent of claim 11, wherein the blades have attachment points along the peak and the base for receiving fasteners to secure the blades to the top and bottom sections.

15. The vent of claim 10, wherein the rotary head is mounted on the support so that the bottom section forms a skirt around the throat, which is proximate the roof of the building.

16. The vent of claim 1, wherein an outer periphery of the top section forms an angle relative to an exit of the throat of 25 degrees so that the roof base component and rotary head are able to operate on an angle to match a roof pitch of up to 15 degrees from horizontal.

17. The vent of claim 1, wherein the roof base component includes a brace that extends across the throat to carry a support on which the rotary head is mounted and the brace, throat and roof base component are integrally formed.

18. The vent of claim 1, further comprising an axial shaft mounted centrally within the rotary head rotationally coupling the rotary head with the roof base and wherein the diffuser is coupled to the axial shaft and adjustable along a length of the axial shaft.

19. The vent of claim 1, wherein the damper is configured to fully close airflow through the diffuser.

* * * * *